US005146815A

United States Patent [19]

Scott, III

[11] Patent Number: 5,146,815

[45] Date of Patent: Sep. 15, 1992

[54] FOLDING TOOL FOR BICYCLES

[75] Inventor: George W. Scott, III, Riverside, Conn.

[73] Assignee: Cannondale Corporation, Georgetown, Conn.

[21] Appl. No.: 668,079

[22] Filed: Mar. 12, 1991

[51] Int. Cl.[5] ..... B25F 1/00

[52] U.S. Cl. ..... 81/437; 81/490; 81/DIG. 7

[58] Field of Search ..... 81/437, 439, 440, 177.1, 81/136, 489, 490, DIG. 7; 7/138, 118, 167, 168, 170

[56] References Cited

U.S. PATENT DOCUMENTS

| | | | |
|---|---|---|---|
| 32,744 | 5/1900 | Cabana | 81/DIG. 7 |
| 1,656,259 | 1/1928 | Young | 7/165 |
| 2,804,970 | 9/1957 | Kuc et al. | 7/138 |
| 3,825,961 | 7/1974 | Klein | 7/118 |
| 4,384,499 | 5/1983 | Shockley | 81/440 |
| 4,699,030 | 10/1987 | Yang | 81/437 |
| 4,785,495 | 11/1988 | Dellis | 81/489 |
| 4,836,066 | 6/1989 | Graham et al. | 81/440 |
| 4,967,435 | 11/1990 | Seals | 81/DIG. 7 |

FOREIGN PATENT DOCUMENTS

| | | | |
|---|---|---|---|
| 0856223 | 12/1960 | United Kingdom | 81/440 |

*Primary Examiner*—Bruce M. Kisliuk
*Assistant Examiner*—Lawrence Cruz
*Attorney, Agent, or Firm*—Brumbaugh, Graves, Donohue & Raymond

[57] ABSTRACT

A folding tool comprises a chassis in the form of a generally U-shaped metal band having a base portion and a pair of substantially parallel spaced-apart leg portions, an axle joined to the leg portions adjacent their free ends and transversely spanning the space between them, and a multiplicity of different elongated tools pivotally received on the axle and individually pivotable selectively about the axle between a storage position in which they are received between the leg portions of the chassis and a deployed position in which they extend away from the chassis. A handle having a top wall, a pair of side walls and one end wall receives the chassis and is joined to it, the handle having a bottom opening between the leg portions of the chassis and an end opening between the free ends of the leg portions through which the tools are movable between their storage and deployed positions. The external surfaces of the top and side walls of the handle are contoured to facilitate gripping.

9 Claims, 3 Drawing Sheets

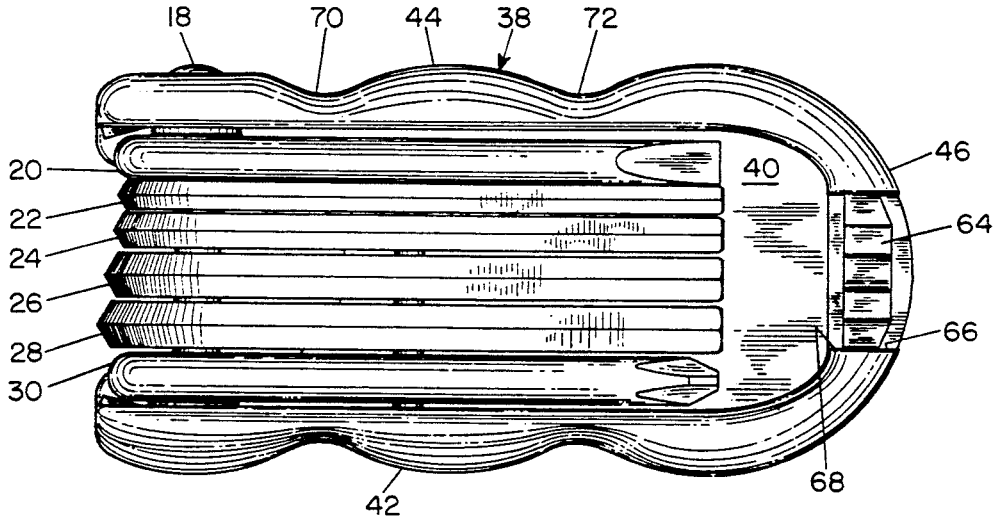
FIG. 6
FIG. 7
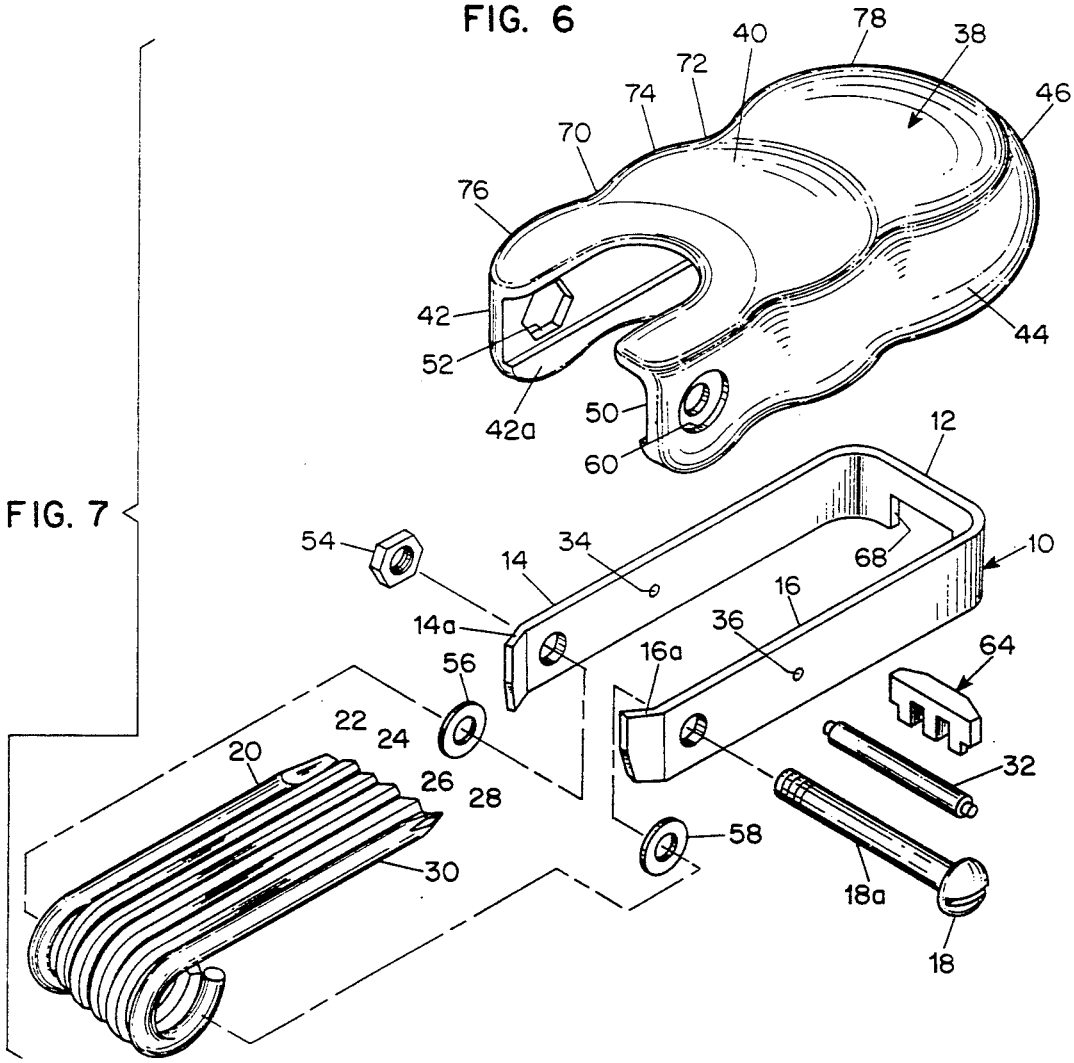

FOLDING TOOL FOR BICYCLES

BACKGROUND OF THE INVENTION

For several years Cannondale Corporation, the assignee of the present invention, has marketed a folding tool for bicycles that is very similar to a folding pocket knife, except that instead of having blades that fold into a storage position between two spaced-apart side walls and open out for use, it has screw drivers and allen wrenches. While the folding tool is compact and very handy to carry, it is not altogether comfortable to use and does not afford a very good grip when used. The two flat sides do not provide good finger or hand grips, and the openings between the sides are not at all satisfactory as grips. Also, the tool has a relatively large number of parts, which makes if fairly expensive to manufacture. The Cannondale folding bicycle tool, which has been widely copied, lacks a spoke wrench, a tool that is very useful to bicyclists.

SUMMARY OF THE INVENTION

One object of the present invention is to provide a folding tool that is ergonomically improved over the prior tool. Another object is to include a spoke wrench. Still a further object is to reduce the number of components and facilitate the assembly of the components and thereby reduce the costs of manufacture. It is also desired to provide an aesthetically pleasing folding tool.

The foregoing an other objects are attained, according to the present invention, by a folding tool comprising a chassis in the form of a generally U-shaped metal band having a base portion and a pair of substantially parallel spaced-apart leg portions, an axle joined to the leg portions adjacent their free ends and transversely spanning the space between them, and a multiplicity of different elongated tools pivotally received on the axle and individually pivotable selectively about the axle between a storage position in which they are received between the leg portions of the chassis and a deployed position in which they extend away from the chassis. A handle having a top wall, a pair of side walls and one end wall fits over the chassis and is joined to it. The handle has a bottom opening corresponding to the opening between the leg portions of the chassis and an end opening between the free ends of the legs portions through which the tools are movable between their storage and deployed positions. The external surfaces of the handle are contoured to facilitate gripping.

Advantageously, the external surfaces of the top and side walls of the handle have spaced- apart concavities and bulbous portions on either side of the concavities. The concavities are in the form of smoothly curved grooves that extend generally transversely and continuously along the top and side walls of the handle. The bases of the grooves may define generally a plane that is orthogonal to the top wall, whereby they are adapted for grasping by the fingers and thumb of a user.

In a preferred embodiment a spoke wrench fitting is joined to the handle adjacent its end wall and has an opening defining jaws for gripping a spoke nut that faces in the same direction as the bottom opening of the handle. When the tools are in their storage position, they are set back within the handle to enable the spoke to intrude into the bottom opening and to be straddled by the side walls when the spoke wrench is fitted to the spoke. The base portion of the chassis and the end wall of the handle have notches that are aligned with the opening between the jaws of the spoke wrench and receive portions of the spoke and spoke nut when the spoke wrench is fitted to the spoke nut.

The axle is, preferably, a portion of a shank of a bolt that passes through a hole in one side wall of the handle and holes in the chassis and receives a nut that is recessed and keyed into the internal surface of the other side wall of the chassis, whereby the bolt and nut fasten the handle to the chassis. The internal surfaces of the side and end walls of the handle match and engage external surfaces of the chassis, and the bottom opening of the handle is bounded by a flange that engages and captures the edge of the chassis.

For a better understanding of the invention reference may be made to the following description of an exemplary embodiment, taken in conjunction with the accompanying drawings.

DESCRIPTION OF THE DRAWINGS

FIG. 6 is a bottom plan view of the embodiment;

FIG. 7 is an exploded pictorial view of the embodiment;

DESCRIPTION OF THE EMBODIMENT

Figure 1:
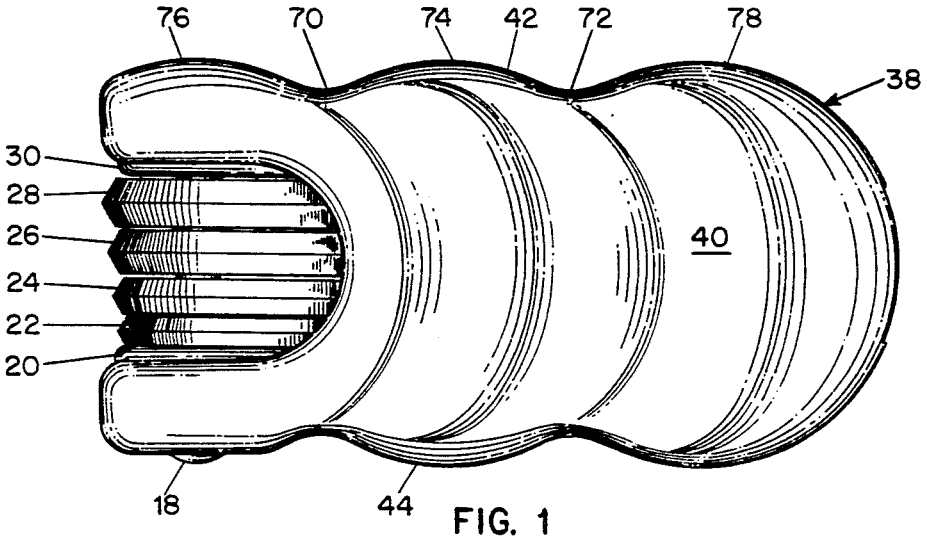
FIG. 1 is a top plan view of the embodiment.
Figure 2:
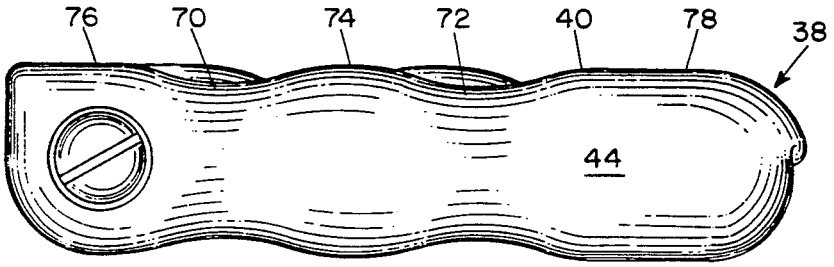
FIG. 2 is a side elevational view of the left side of the embodiment.
Figure 3:
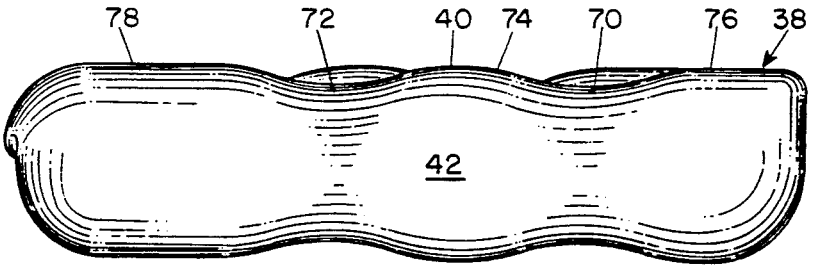
FIG. 3 is a side elevational view of the right side of the embodiment.
Figure 4:
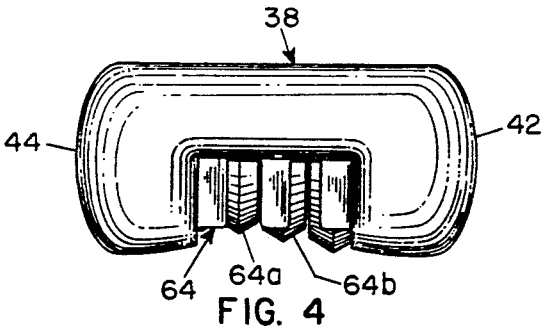
FIG. 4 is an end elevational view of the handle end of the embodiment.
Figure 5:
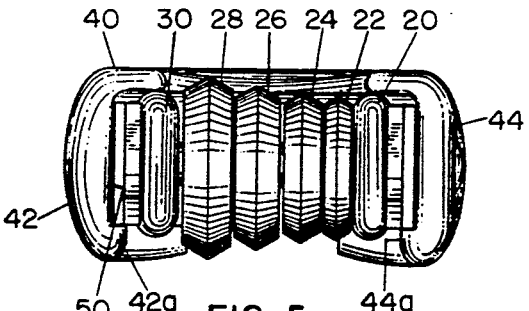
FIG. 5 is a end elevational view of the tool end of the embodiment.
Figure 8:
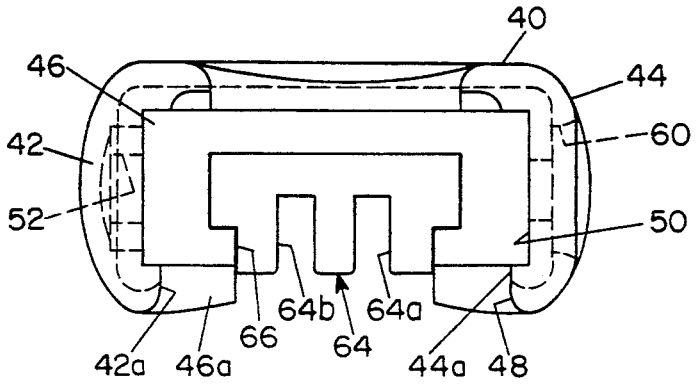
FIG. 8 is an end elevational view of the handle of the embodiment, looking toward the tool end.
Figure 9:
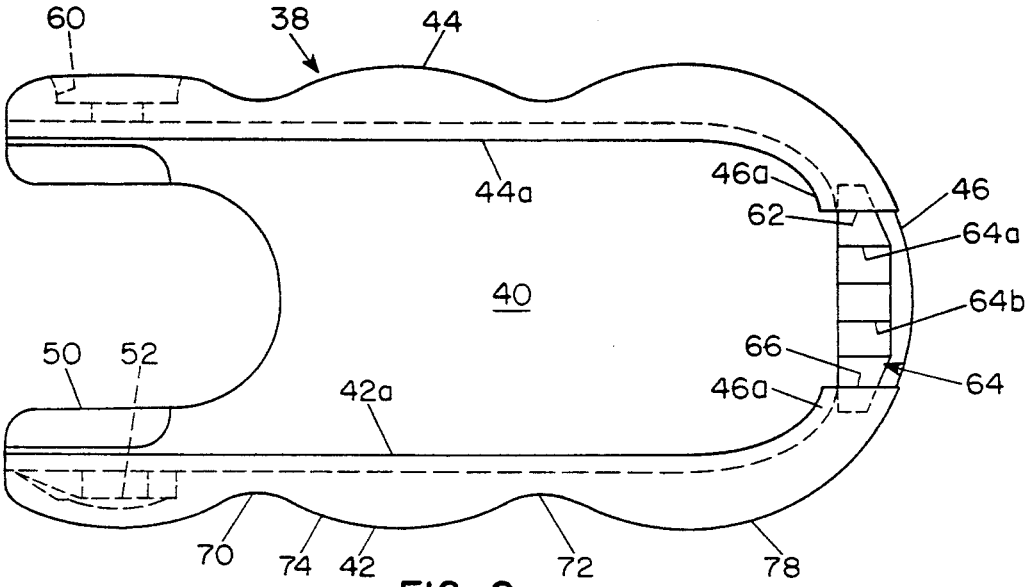
FIG. 9 is a bottom plan view of the handle of the embodiment.

The embodiment comprises a chassis 10 in the form of a metal band bent into a "U" shape such as to form a base portion 12 and a pair of parallel, spaced-apart leg portions 14 and 16. The shank 18*a* of a bolt 18 serves as an axle for six elongated tools, a slotted head screw driver 20, four sizes of allen wrenches 22, 24, 26, and 28, and a phillips head screw driver 30. The ends of the tools remote from the working tips are bent into loops, by which they are pivotally mounted on the bolt 18 for pivotal movement individually between a storage position in which they reside between the leg portions 14 and 16 of the chassis and a deployed position in which they extend out away from the chassis. Each of the free ends of the leg portions 14 and 16 has a small protuberance 14*a*, 16*a* stamped into it in an inward direction (toward the space between the leg portions) that interferes with the respective screw drivers 20 and 30 and holds them in the manner of a detent in the deployed position. A stop pin 32 is press-fitted into holes 34, 36 in the leg portions of the chassis and is engaged by the tools 20–30 when they are folded into their storage position between the leg portions.

The chassis 10 and tools 20–30 are received within a molded plastic handle 38. The handle has a top wall 40, a pair of side walls 42 and 44, a rear end wall 46, a bottom opening 48 defined by the edges of the side and rear end walls, and a front end opening 50 defined by the ends of the top wall and the side walls at the end opposite from the rear end wall 46. Internally, the side and rear end walls 42, 44 and 46 are formed to provide a receptacle for the chassis 10, the receptacle being shaped and dimensioned to match the external surface of the chassis. Edge flange portions 42*a*, 44*a*, and 46*a* project in at the bottom opening of the handle and engage the bottom edge of the chassis, thereby capturing it in the handle from below. The chassis 10 slides into the handle 38 through the front end opening 50 when the tool is assembled.

A recess 52 on the inside of the side wall 42 of the chassis 10 receives a nut 54, the recess matching the shape of the nut so that the bolt 18 can be tightened onto it. After the nut is installed in the recess, the chassis is slid into the handle, the tools are positioned to accept the axle bolt 18, washers 56 and 58 are inserted on opposite sides of the tool array, and the bolt is inserted through a countersunk hole 60 in the side wall 44, the tools and washers and threaded into the nut 54. Thereupon, the chassis and tools are securely retained in the handle, the chassis being held in the receptacle formed by the interior of the handle and the bolt and nut holding the chassis/tool assembly endwise.

Figure 10:
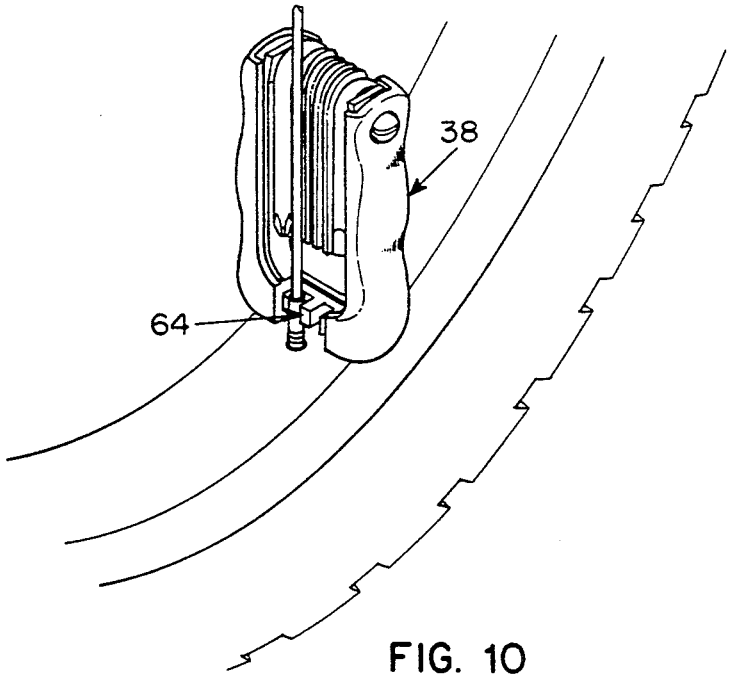
FIG. 10 is a pictorial view showing how the spoke wrench is used.

A cavity 62 in the rear end wall 46 of the handle receives a spoke wrench fitting 64, which can either be molded in place in the handle or pressed into the previously molded handle. The fitting 64 has two wrench-openings 64*a* and 64*b* of different sizes for use with different sized spoke nuts. A notch 66 in the rear end wall 46 of the handle and a notch 68 in the base portion 12 of the chassis 10 register with the wrench-openings of the fitting 64 and accept the shank of the spoke nut when the spoke wrench is used (see FIG. 10). The stop pin 32 is located relative to the chassis such that the working tips of the tools, when in their storage positions, are recessed into the bottom opening 48 of the handle sufficiently to allow the spoke in intrude into the portion of the bottom opening adjacent the spoke wrench—the spoke forms a small angle with the plane of the bottom opening when the spoke wrench is applied to the spoke nut.

The external surface of the handle 38 is sculptured to provide finger and thumb grips in the form of spaced-apart, smoothly curved grooves or concavities 70 and 72 extending transversely and continuously along the top wall 40 and side walls 42 and 44, a smoothly curved bulbous portion 74 between the concavities, and smoothly rounded bulbous portions 76 and 78 adjacent the front and rear ends. The end wall 46 is smoothly rounded at the junctures with the side and top walls, also for improved comfort and ergonomic characteristics.

I claim:

1. A folding tool comprising a chassis in the form of a generally U-shaped metal band having a base portion at one end and a pair of elongated substantially parallel spaced-apart leg portions extending from the base portion and having free ends remote from the base portions, an axle joined to the leg portions adjacent their free ends and transversely spanning the space between them, a multiplicity of different elongated tools pivotally received on the axle and individually pivotable selectively about the axle between a storage position in which they are received between the leg portions of the chassis and a deployed position in which they extend away from the chassis, and a handle having a top wall, a pair of side walls and one end wall receiving the chassis and joined to it, the chassis being received in the handle with the leg portions engaging the side walls and the base portion engaging the end wall, and the handle having a bottom opening between the leg portions of the chassis and an end opening between the free ends of the leg portions through which the tools are movable between their storage and deployed positions, the external surfaces of the top and side walls of the handle being contoured to facilitate gripping.

2. A folding tool according to claim 1 wherein the external surfaces of the top and side walls of the handle have spaced apart concavities and bulbous portions on either side of the concavities.

3. A folding tool according to claim 2 wherein the concavities are smoothly curved grooves that extend generally transversely and continuously along the top and side walls of the handle.

4. A folding tool according to claim 3 wherein the bases of the grooves define generally a plane that is orthogonal to the top wall, whereby they are adapted for grasping by the fingers and thumb of a user.

5. A folding tool according to claim 1 and particularly adapted for use with bicycles and further comprising a spoke wrench fitting joined to the handle adjacent its end wall and having a wrench-opening defined by jaws for gripping a spoke nut that faces the bottom opening of the handle.

6. A folding tool according to claim 5 wherein the tools in their storage position are set back within the handle to enable the spoke to intrude into the bottom opening and to be straddled by the side walls when the spoke wrench is fitted to the spoke.

7. A folding tool according to claim 1 wherein the axle is a portion of a shank of a bolt that passes through a hole in one side wall of the handle and holes in the chassis and receives a nut that is recessed and keyed into the internal surface of the other side wall of the chassis, whereby the bolt and nut fasten the handle to the chassis.

8. A folding tool according to claim 7 wherein the internal surfaces of the side and end walls of the handle match and engage external surfaces of the chassis and the bottom opening of the handle is bounded by an inturned flange that engages and captures the edge of the chassis.

9. A folding tool according to claim 5 wherein the base portion of the chassis and the end wall of the handle have notches that are aligned with the opening between the jaws of the spoke wrench and receive portions of the spoke and spoke nut when the spoke wrench is fitted to the spoke nut.

* * * * *